US005137222A

United States Patent [19]

Katada

[11] Patent Number: 5,137,222

[45] Date of Patent: Aug. 11, 1992

[54] COP FEEDING APPARATUS FOR AUTOMATIC WINDER

[75] Inventor: Kenji Katada, Kanazawa, Japan

[73] Assignee: Kabushiki Kaisha Murao and Company, Kanazawa, Japan

[21] Appl. No.: 668,990

[22] Filed: Mar. 12, 1991

[51] Int. Cl.[5] ..... B65H 67/02

[52] U.S. Cl. ..... 242/35.5 A

[58] Field of Search ..... 242/35.5 A, 35.5 R, 242/35.6 R

[56] References Cited

U.S. PATENT DOCUMENTS

| | | | |
|---|---|---|---|
| 3,774,859 | 11/1973 | Brouwer et al. | 242/35.5 A X |
| 4,571,931 | 2/1986 | Küpper | 242/35.5 A X |
| 4,576,340 | 3/1986 | Aretz et al. | 242/35.5 A |
| 4,666,095 | 5/1987 | Küpper | 242/35.5 A |
| 4,685,630 | 8/1987 | Bühren et al. | 242/35.5 A |
| 4,742,967 | 5/1988 | Sanno et al. | 242/35.5 A |

*Primary Examiner*—Stanley N. Gilreath
*Attorney, Agent, or Firm*—Oblon, Spivak, McClelland, Maier & Neustadt

[57] ABSTRACT

A cop feeding apparatus for an automatic winder for feeding cops which are carried on trays and conveyed along a conveyance rail automatically to empty spindle portions of cop magazines in the automatic winder while moving along the conveying rail. In this cop feeding apparatus, a cop is pulled out from a tray by a cop draw-out device; a yarn end of the cop is held by a yarn end draw-out device; the cop is then fed to an empty spindle portion of a magazine through a storage device and a retaining/introducing device; a yarn end of the cop is delivered securely to the magazine side by a yarn end guide device; and thus each cop and a yarn end thereof can be fed to an empty magazine spindle portion smoothly without entanglement of cops with each other.

9 Claims, 12 Drawing Sheets

COP FEEDING APPARATUS FOR AUTOMATIC WINDER

BACKGROUND ART

The present invention relates to an apparatus for feeding cops automatically to an automatic winder with cop magazines which winder is generally used in spinning mills. More particularly, the present invention is concerned with a cop feeding apparatus for an automatic winder wherein cops to be fed are carried on trays on a tray conveyance rail disposed above the automatic winder, then pulled out and stored, and held each individually while yarn ends are drawn out, then empty cop magazine spindle portions are detected and cops are fed thereto.

There have been proposed various automatic cop feeding apparatus for automatic winders with cop magazines wherein an empty magazine spindle portion is detected and cop is fed thereto automatically. As examples of such cop feeding apparatus there are mentioned a stationary type wherein cop magazines are provided with cop introducing means to receive a cop being conveyed for feed upon occurrence of an empty spindle portion, or storage means for a large number of cops are provided on each cop magazine, and every time an empty spindle portion is detected, the cops are fed successively from the one located at the bottom, and a distribution type wherein a large number of cops to be fed are accommodated in a cop feeding device, and when the cop feeding device detects an empty spindle portion while moving along cop magazines, it feeds a cop to the magazine of the empty spindle portion.

In the former stationary type, the apparatus is large-scaled, the provision of a special member near the magazines causes an obstracle to operation, and the maintenance and control of the winder are difficult. Under the circumstances, the distribution type has recently attracted attention of many concerns. Even in the distribution type, however, an automatic feeding apparatus which travels while holding a large number of cops to be fed is increased in weight, so the travelling equipment becomes very large-scaled and it is necessary to provide means for feeding out each cop. In view of these points there has been developed an apparatus wherein a conveyance line for feeding out cops, and a cop feeding device receives and stores a predetermined number of cops from the conveyance line and feeds a cop to an empty spindle portion of a magazine automatically. In this distribution type of apparatus, a flat belt type conveyor is used as a cop conveyance rail, and the automatic cop feeding device receives a large number of cops only in a specific position and stores the received cops in a stacked state. As to this construction, drawbacks have been pointed out, such as, for example, stain of cop during conveyance on the flat belt conveyor, or the likelihood of disorder of the yarn layer. Also pointed out is that the loading of magazine is not smooth.

The applicant in the present case proposes in U.S. Pat. No. 4,742,967 a cop feeding apparatus wherein cops are conveyed while being carried on trays and are fed each individually to an empty magazine spindle portion.

OBJECT OF THE INVENTION

It is the object of the present invention to provide a cop feeding apparatus capable of receiving and storing a minimum required number of cops being conveyed while carried on trays and feeding a cop thus stored to an empty magazine spindle portion in an optional position and also capable of processing a yarn end of the cop and feeding it to the magazine side smoothly without entanglement.

A series of the above operations are performed in a simple manner, so the apparatus itself is not complicated in structure, and the maintenance and control thereof are easy, with few troubles.

DISCLOSURE OF THE INVENTION

The cop feeding apparatus of the present invention is provided for each winder, reciprocates along cop tray conveying rails provided along a machine frame at the upper portion of the winders, and feeds cops on one of the reciprocative paths. This cop feeding apparatus comprises a cop pull-out device for pulling out a cop from a tray; a yarn end draw-out device for storing the pulled-out cop temporarily in a cylindrical form, drawing out and holding a yarn end of the cop and conducting it to a cutting device; a retaining device for temporarily storing the cop whose yarn end has been drawn out and allowing it to stand by for feeding to a retaining/introducing device disposed thereunder; and the retaining/introducing device for temporarily storing the cop fed from the retaining device, detecting an empty magazine spindle portion and introducing the cop into the magazine. The cop feeding apparatus of the invention is further provided with means for opening a yarn end suction port on the magazine side prior to the feed of cop and conducting a yarn end of the cop fed to the opened suction port. These operations are performed successively by the rotation of a single driving shaft.

BRIEF DESCRIPTION OF THE DRAWINGS

FIGS. 1 to 20 illustrate a cop feeding apparatus according to an embodiment of the present invention, of which:

FIG. 1 is a partially cut-away from view thereof;

FIG. 3 is a partially enlarged broken view of FIG. 2;

FIG. 4 is a partial plan view of FIG. 4;

FIG. 5 is a partial plan view of FIG. 6;

FIG. 6 is a partially enlarged view of FIG. 3;

FIG. 7 is a left side view of FIG. 6;

FIG. 8 is a partial plan view taken along line VIII—VIII in FIG. 6 , as seen in the direction of arrows;

FIG. 9 is a developed sketch diagram;

FIG. 10 is a view explanatory of operation of a part of FIG. 8;

FIG. 11 is a partially enlarged view of the right-hand side of FIG. 3;

FIG. 12 is a right side view of FIG. 11;

FIGS. 13, 14, 15, 16 and 17 are sectional views taken along lines VIII—VIII, XIV—XIV, XV—XV, XVI—XVI and XVII—XVII in FIG. 12, as seen in the direction of arrows;

FIG. 18 is a partial side view of the left-hand side of FIG. 19;

FIG. 19 is a partially enlarged view of FIG. 3; nd

FIG. 20 is a sectional view taken along line XX—XX in FIG. 19, as seen in the direction of arrows.

DETAILED DESCRIPTION OF THE INVENTION

An embodiment of the present invention will be described in detail hereinunder with reference to the accompanying drawings.

Figure 1:
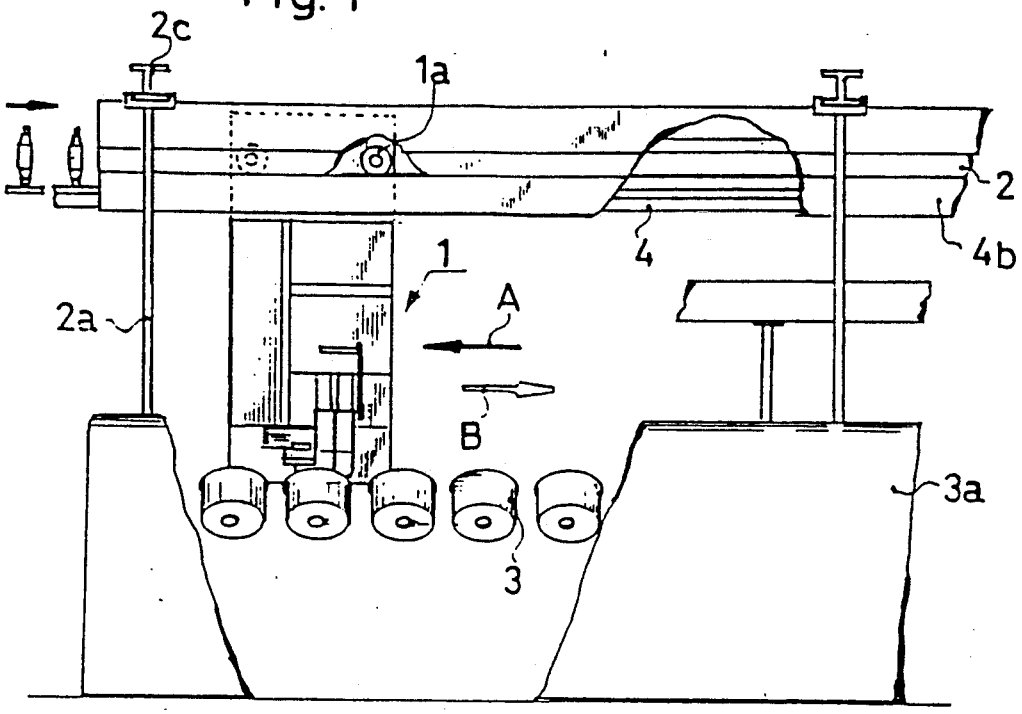
Figure 2:
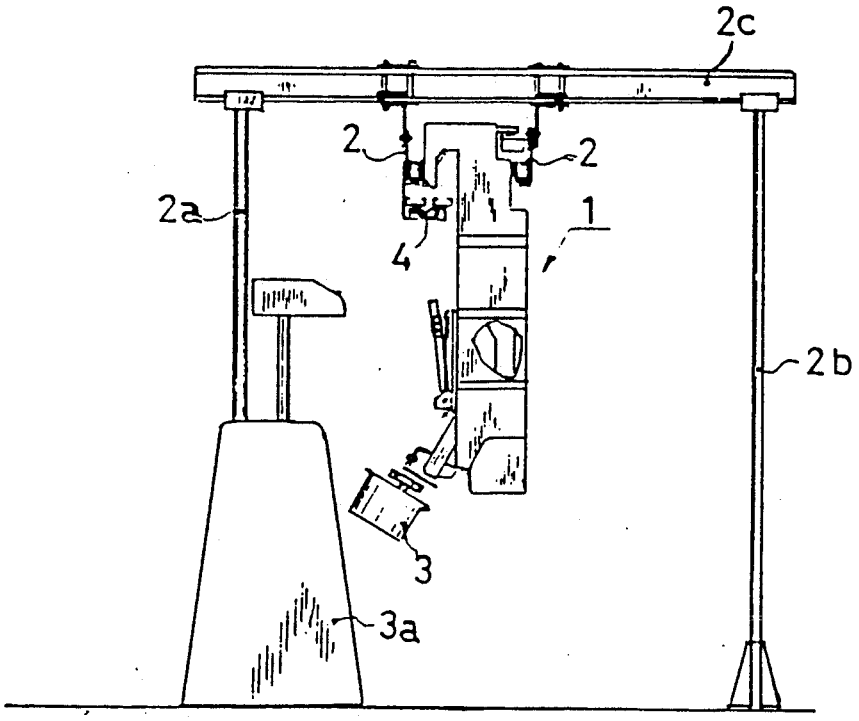

In FIG. 1 (a partially cut-away front view) and FIG. 2 (a right side view of FIG. 1), a cop feeding apparatus 1 is provided in an opposed relation to an automatic winder 3a. The automatic winder 3a is provided with a plurality of rotary cop magazines 3 in a row for the storage of plural cops. The cop feeding apparatus 1 is constructed to travel along guide rails 2, 2 suspended from a beam 2c which is mounted bridgewise between a support rod 2a erected on the winder 3a and a support rod 2b erected on the floor. The guide rails 2 are disposed in parallel along the row of the magazines 3.

The cop feeding apparatus 1 is constructed so that the cops introduced therein are stored or retained in three stages. More specifically, a retained cop which has reached the lowest stage is fed to an empty magazine spindle portion, whereby cops are supplied successively from the upper-stage side storage portion.

Figure 3:
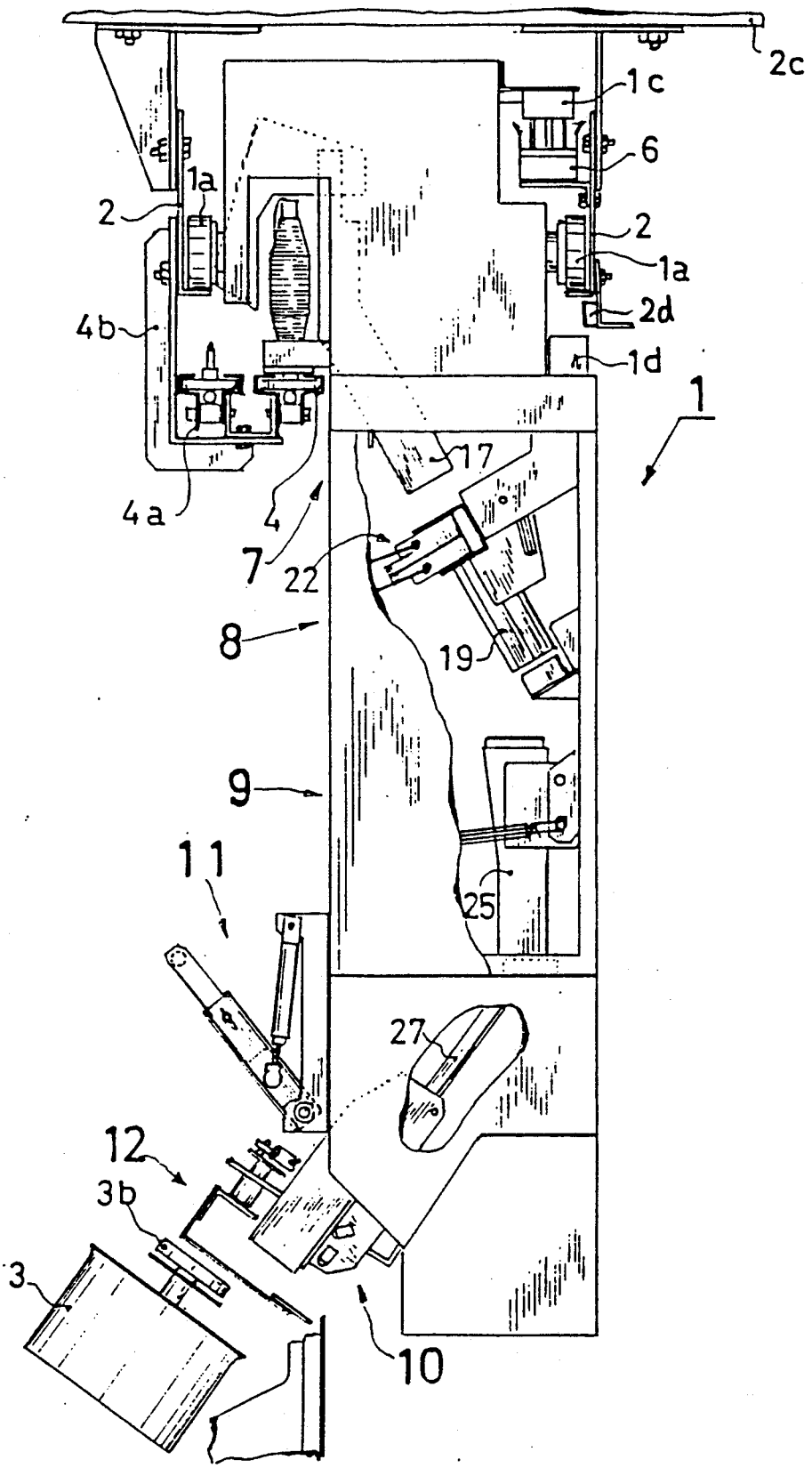

The cops to be fed are conveyed while being carried on trays on a tray rail 4 disposed along the guide rails 2, and cop feeding apparatus 1 pulls out the cops from the trays and stores them. The tray rail 4 comprises two rows 4, 4a mounted to one guide rail 2 through a bracket 4b, as shown in FIG. 3 (a partially enlarged broken view of FIG. 2). The tray rail 4 on the side closer to the cop feeding apparatus 1 serves as a cop tray passage, while the tray rail 4a on the other side is used as an empty tray return rail.

Figure 4:
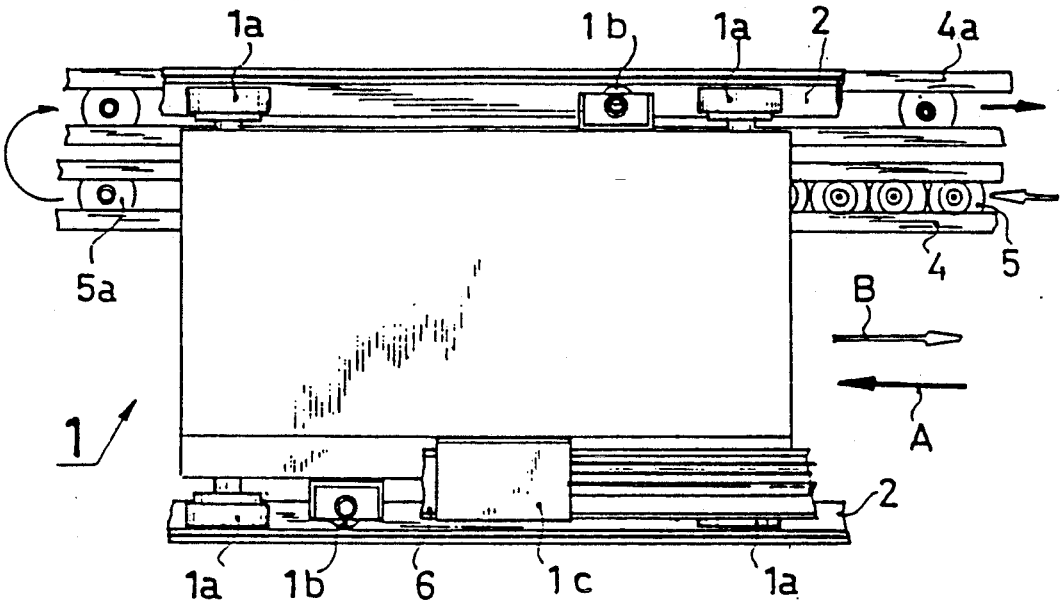

More specifically, as shown in FIG. 4 (a partial plan view of FIG. 3), the cop feeding apparatus 1 reciprocates like arrows A and B along the guide rails 2, 2 through one of pulley pairs 1a and 1a which one pair serve as positive driving wheels driven by a drive unit provided in the apparatus 1. Driving power for the cop feeding apparatus 1 and pressurized air for a later-described actuator are supplied through a connection 1c held by a cord pipe guide rail 6 which is provided in parallel with the guide rails 2. As the guide rail 6 there is used a foldable protective cover (trade name: CAP-FLEX). The numerals 1b, 1b represent guide pulley provided in the apparatus 1.

The tray rail 4 conveys the trays 5 with cops in the direction of a white arrow, and at an end portion each empty tray 5a after the removal of cop in the cop feeding apparatus 1 is conducted to the return tray rail 4a as indicated by an arrow and conveyed to a cop loading device as indicated by a black arrow. These tray rails are constructed so that the trays are moved in contact with a single circular belt disposed on the bottom side of the guide rails. Each tray is retained in an optional position by a restriction member and the succeeding trays are also retained in contact with the retained tray, while only the belt continues to move. When the cop feeding apparatus 1 moves in the direction of arrow B, i.e., in the direction opposite to the moving direction of the cop tray 5, it stops upon detection of an empty spindle portion of a magazine 3 and introduces a retained cop into the magazine. The travelling direction of arrow A indicates return to the start position, in which the cop introducing operation is not performed.

Figure 11:
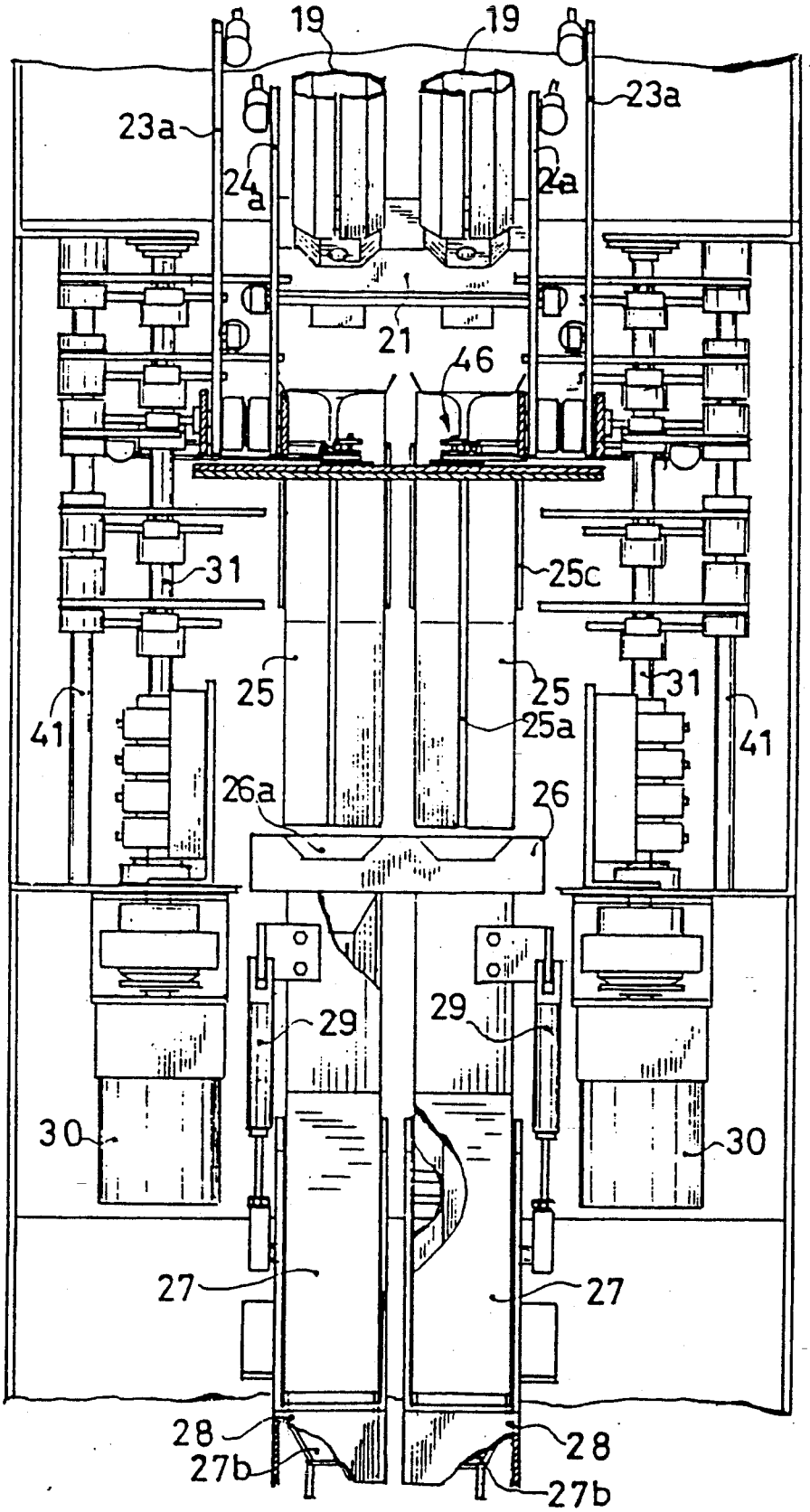

As shown in FIG. 3, the cop feeding apparatus 1 is constructed to store and retain each cop which has been taken in, in the three stages of a yarn end draw-out device 8, a stand-by/storage device 9 and a retaining-/introducing device 10. These devices constitute substantially vertical, left and right rows of storage lines, as illustrated in FIG. 11 (a partially enlarged view of the left-hand side of FIG. 3). This is for the following reason. Generally, the number of empty spindle portions in a magazine is one, for which the supply of cop can be done by only the right-hand storage line in the figure. But at some particular feed timing there are two empty spindle portions in one magazine, so in this embodiment the cop feeding apparatus can feed cops to such two empty spindle portions at a time.

The storage devices 9 and the retaining devices 10 are constituted so that they can each store and retain a cop to prevent feed cops from contacting each other. On the other hand, only one cop pull-out device 7 is provided. The cop pull-out device 7 is arranged facing the cop tray conveying path, and it traverses between the two sets of storage devices 8 at the upper portions of these devices 8. Therefore, cops can be directed through either the left or right storage line from the cop pull-out device 7.

Figure 5:
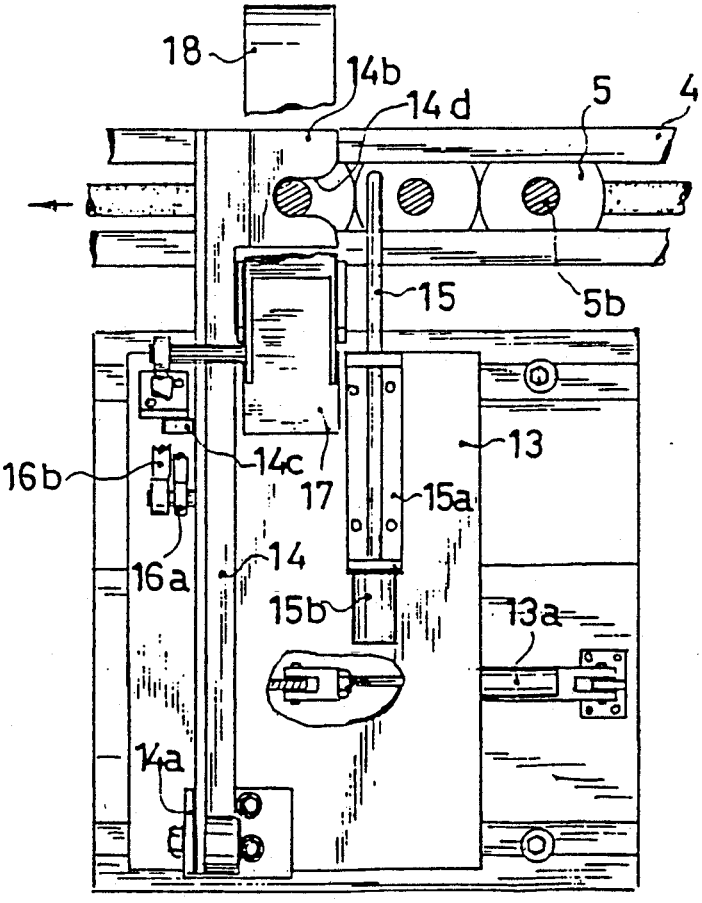
Figure 6:
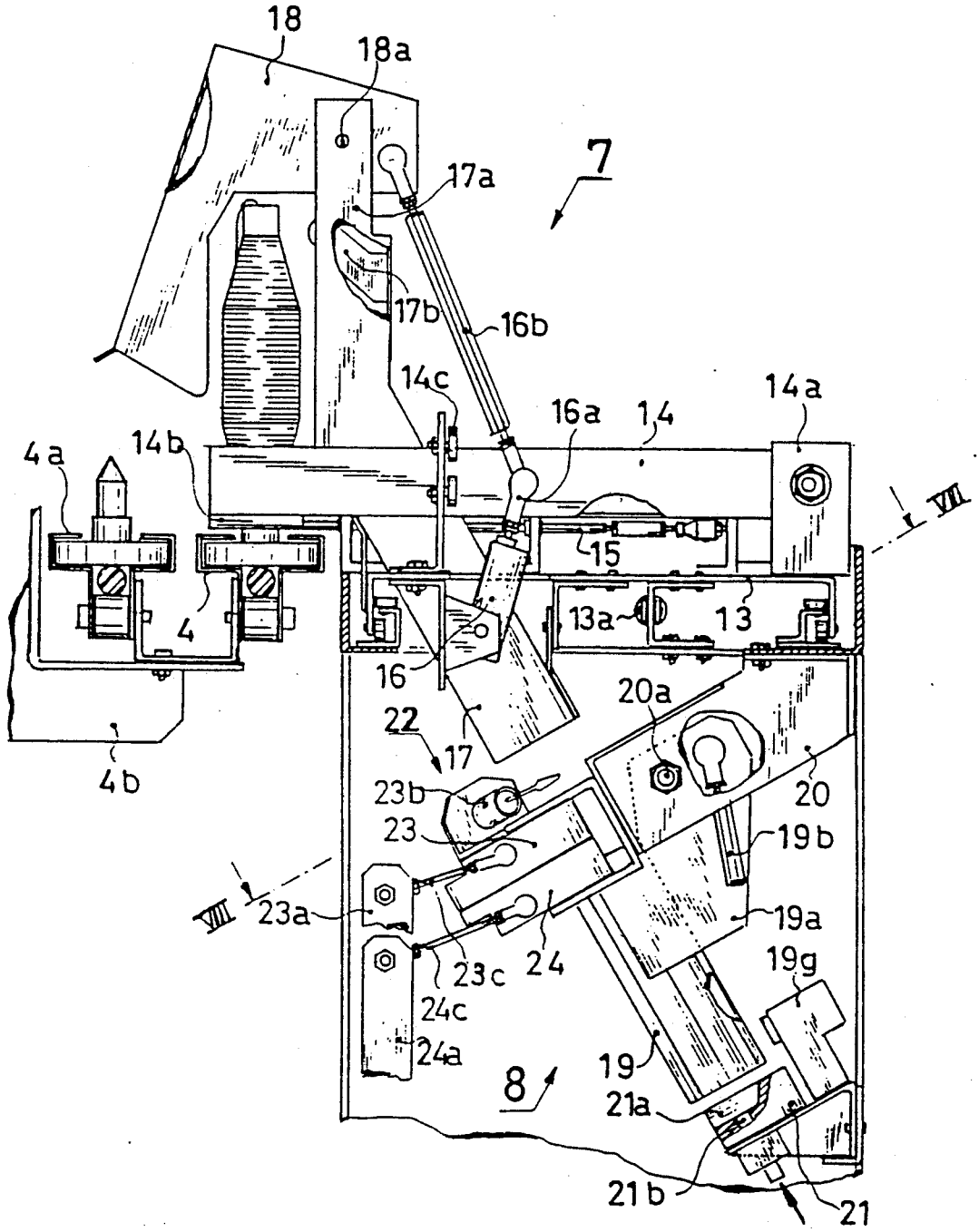
Figure 7:
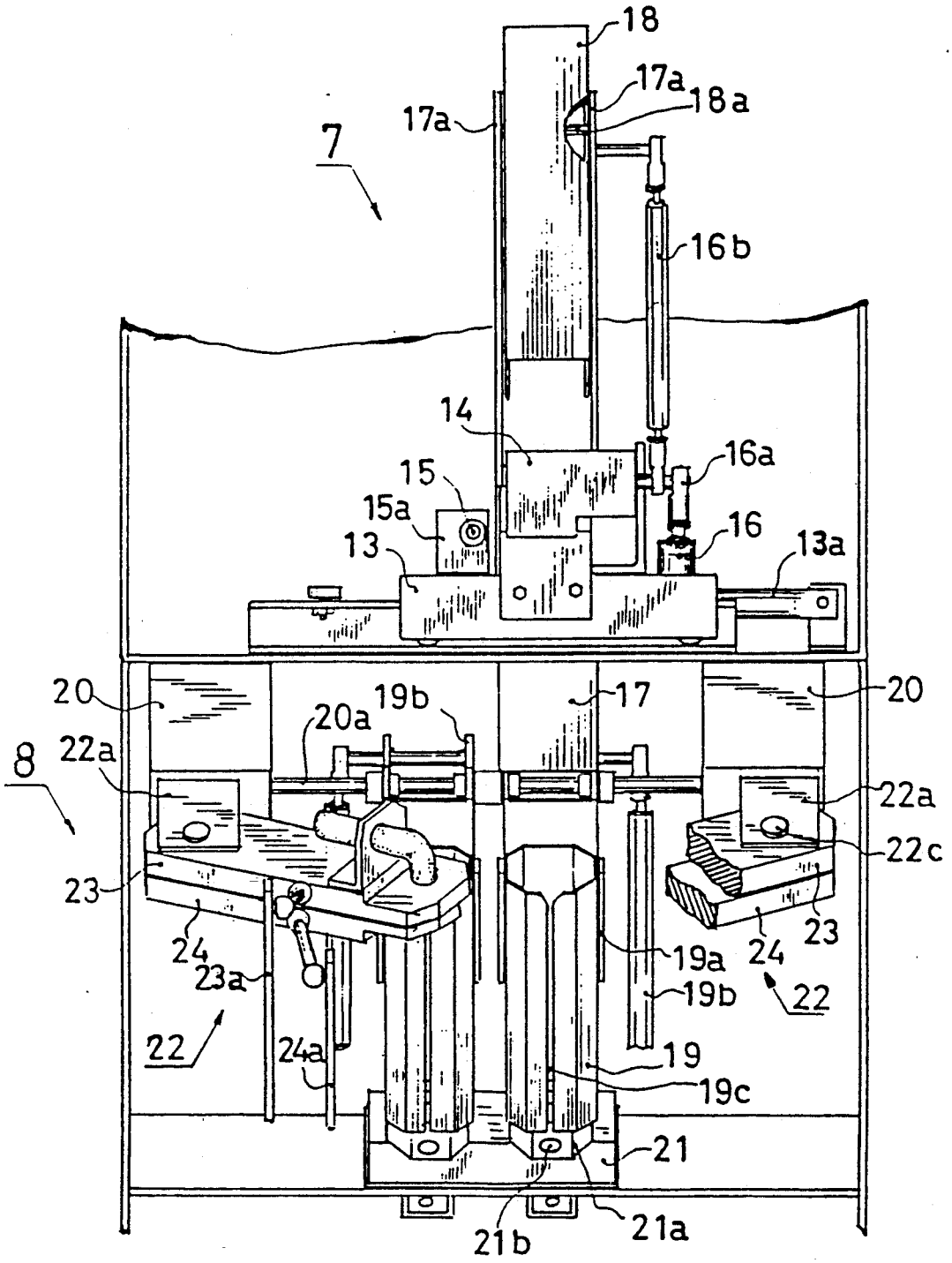

In the cop pull-out device 7, as illustrated in FIG. 5, FIG. 6 (a partially enlarged view of FIG. 3) and FIG. 7 (a left side view of FIG. 6), a pull-out arm rod 14, a retaining rod 15, an actuating cylinder 16 and a chute 17 are provided on a movable base 13. The movable base 13 is provided movably with respect to a frame and is moved to either the right or the left storage line (in FIG. 7) by an actuating cylinder 13a. This movement is done upon detection of the lack of a stored cop for the yarn end draw-out device 8 which will be described later, to effect pulling out and supply of a cop.

As shown in FIG. 5 (a partial plan view of FIG. 6), the pull-out arm rod 14 is pivotally connected at one end thereof to a bracket 14a provided on the movable base 13, and to an approximately central part thereof is pivotally connected a piston-side end 16a of the actuating cylinder 16. Further, at an opposite end portion of the pull-out arm rod 14 is formed a bent portion 14b, and on one side of the bent portion 14b is formed a recess 14d for fitting therein of a cop inserting stepped portion 5b. The outside diameter of the stepped portion 5b is smaller than the base-side outside diameter of a cop bobbin, so the cop can be pulled up from the tray by a pivoting motion of the pull-up arm rod 14.

The stand-by position of the pull-out arm rod 14 is such that the bent portion 14b is located above the tray rail 4 as shown in FIG. 6, and the height thereof corresponds to the cop inserting stepped portion 5b of the tray 5.

On the cop tray incoming side of the pull-out arm rod 14 there is provided a retaining rod 15 so as to be movable forward and backward. As shown in FIG. 5, the retaining rod 15 is mounted slidably to a slide bracket 15a and is operated by an actuating cylinder 15b. In FIG. 5, the retaining rod 15 is in a projected state. More specifically, the retaining rod 15 restricts the movement of the tray 5 entering the bent portion 14b of the pull-out arm rod and retains it. It is located in an intermediate position of abutment of the succeeding tray with the tray which again entered the bent portion 14b after release of the retained state thereof by the retaining rod 15, as shown in FIG. 5. Therefore, when the cop on the preceding tray was pulled out and the tray now as an empty tray left the bent portion, the succeeding tray is retained by the retaining rod 15. At every retraction of the retaining rod, a tray is pulled out and fed to the arm rod side.

On the other hand, as shown in FIGS. 6 and 7, the chute 17 is formed by an open cylinder having a square section and is provided inclinedly through the movable base 13. The portion of the chute 17 positioned higher than the movable base 13 is opened on the front side thereof, and both side walls thereof are projected upward to form support portions 17*a*. A pivotable guard 18 is provided through a pivot shaft 18*a* attached to the support portions 17*a*. The pivotable guard 18 is pivotally supported on one side thereof by both a mounting shaft of the arm rod 14 for the piston-side end 16*a* of the actuating cylinder and a connecting rod 16*b*. Inside the opening portion of the chute 17 is provided a restricting piece 17*b* in a corresponding relation to the top position of the cop.

Under the above construction, when the arm rod 14 pivots in the clockwise direction in FIG. 6 and pulls up a cop from the tray, the pivotable guard 18 pivots counterclockwise at the same time and introduces the pulled-up cop into the opening portion of the chute 17 like scooping up positively. At this time, the top of the cop comes into contact with the restricting piece 17*b*, so that it is possible to pull out the cop securely while allowing the base side thereof to face the chute 17 side and conduct it into the chute 17. The cop which has thus been conducted to the chute is introduced into a cop storage/receiving cylinder 19 of the yarn end draw-out device 8 having an inclined stand-by position like the chute 17 just under the chute.

The yarn end drawout device 8, stand-by/storage device 9 and retaining/introducing device 10 will now be described. These devices each have a double-row construction as in the foregoing cop storage device, which rows are symmetric in structure and operation, so either one will be explained below.

As shown in FIGS. 6 and 7, the yarn end draw-out device 8 is composed of the receiving cylinder 19 supported pivotably and a yarn end suction/holding/guide device 22 provided sideways on the inlet side of the cylinder. The receiving cylinder 19 is an octagonal through cylinder having a slit 19*c* on the front side thereof (left-hand side in FIG. 6). It is fixed to a mounting frame 19*a*, which is supported by a shaft 20*a* mounted bridgewise between brackets 20, 20. One end of an actuating rod 19*b* is pivotally connected to a part of the rear side of the frame 19*a*, so that the receiving cylinder 19 is pivotally moved by the operation of the actuating rod 19*b*. When the cylinder 19 is held in its stand-by position (as shown), a cop support base 21 is positioned under the cylinder 19, the support base 21 being mounted to brackets attached to the frame. On the support face side of the support base 21 is formed recess 21*a* for fitting therein of the base portion of a cop bobbin for storage. The front side of the recess 21*a* is open and nearly centrally thereof is formed a vent hole 21*b* in an opposed relation to the hollow bore of the cop bobbin.

To the underside of the support base 21 is connected a pressurized air introducing pipe through a bracket, which pipe is in communication with the vent hole 21*b*. The yarn end of the cop introduced has already been conducted to the top hole of the bobbin, so by applying pressurized air through the pipe to the cop which has been introduced and stored in the receiving cylinder 19, the yarn end of the cop is blown off from the top hole of the cop.

Figure 8:
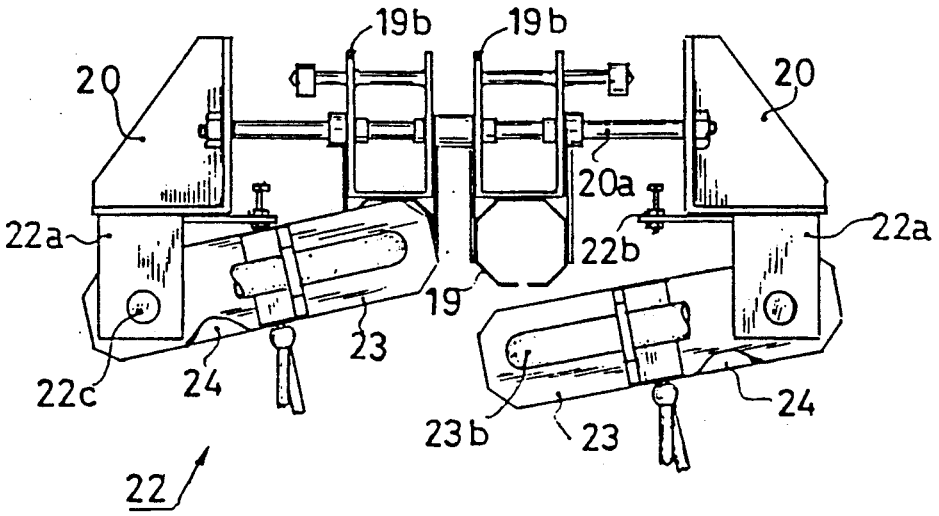
Figure 9:
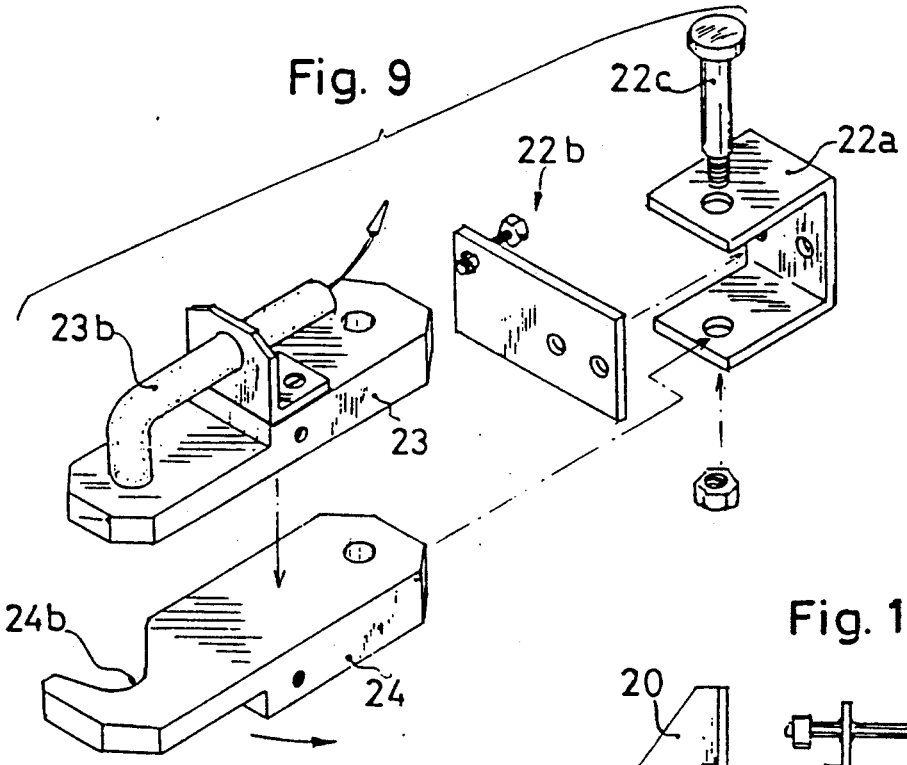

On the other hand, the yarn end suction/holding/guide device 22 is constructed as shown in FIG. 7, FIG. 8 (a partial plan view taken along line VIII—VIII in FIG. 6 as seen in the direction of arrow) and FIG. 9 (a developed sketch diagram). As illustrated therein, in front of each bracket 20, a suction board 23 and an opening/closing plate 24 overlap each other through a ]-shaped bracket 22*a* and are pivotally supported by a pivot shaft 22*c*. On the front side of the suction board 23 is formed a through hole, to which is connected a suction pipe 23*b*. Further, a thin stepped portion is formed on the front side of the opening/closing plate 24, and this stepped portion is formed with a recess 24*b* which is open on one edge side of the stepped portion. To the suction board 23 and the opening/closing plate 24 are connected such connecting rods 23*c* and 24*c*, respectively, as shown in FIG. 6, which rods are connected at the other ends to actuating rods 23*a* and 24*a*, respectively. Numeral 22*b* denotes a position restricting stopper. A suction air stream introduced into the suction pipe 23*b* conducts a suction stream formed by a pressurized air jet introduced.

Figure 10:
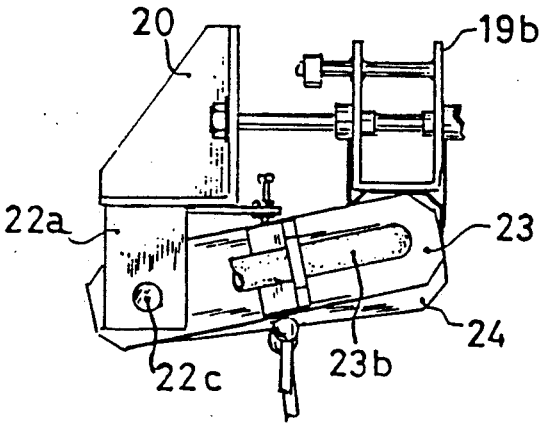

As shown in FIG. 8, the suction board 23 and the opening/closing plate 24 are advanced (left-hand side in FIG. 8) into the portion above the cop storage/receiving cylinder 19 or retracted (right-hand side) in an overlapped manner by the actuating rods 23*a* and 24*a*. When they are in the advanced position, the through hole of the suction board 23 is opposed to the top hole of the cop stored in the receiving cylinder 19. The opening/closing plate 24 is adapted to operate independently and is displaced from the suction board 23 as in FIG. 10 (an explanatory view of the operation of a part of FIG. 8). By this displacement the suction air stream is exerted on the cop side. More specifically, when the suction board 23 and the opening/closing plate 24 are in an exactly overlapped state as in FIG. 8, the through hole of the suction board 23 is closed with the this stepped portion of the opening/closing plate 24, while when the plate 24 turns slightly as in FIG. 10, the through hole is opened in the presence of the recess 24*b* to form a suction air stream. Consequently, not only the suction board 23 can suck in the yarn end of the cop which has been introduced into the top hole of the cop in the state of FIG. 10, but also the feed of air from the support base 21 is also utilized for ensuring the said suction.

The displacing motion of the opening/closing plate 24 is for a slight period of time, and by moving it back to its original position to overlap the opening/closing plate 23 and the suction board 23 with each other as in FIG. 8 or by slightly turning the suction board 23 side to effect such overlapping, the opening/closing plate 24 hold the sucked yarn end. When the plate 24 and the suction board 23 turn in this overlapped state as in the right-hand side of FIG. 8, the sucked yarn end is taken out from the slit of the receiving cylinder 19. By this turning motion the yarn end which has been sucked and grasped is conducted to a position above a cutter 46 (see FIG. 11) which will be described later, so that the yarn end of the stored cop is unwound slightly. Then, the cop stored in the stand-by/storage device 9 is dropped, the actuating rod 19*b* operates to pivot the receiving cylinder 19 clockwise in FIG. 6, whereby the cop supported by the support base 21 is introduced into a cop holding cylinder 25 (see FIG. 11) of the stand-by/storage device.

Behind the support base 21 is provided a detector 19*g* (FIG. 6) for detecting the presence of the cop stored in the receiving cylinder 19. The detector 19g includes a photoelectric means which determines whether or not a cop is present through a window hole (not shown) formed in the cylinder 19. When no cop is present therein, the cop pull-out device 7 is moved to the storage line side, or confirmation is made to check that the same device is moving, then an operation is performed to take in the cop.

Figure 12:
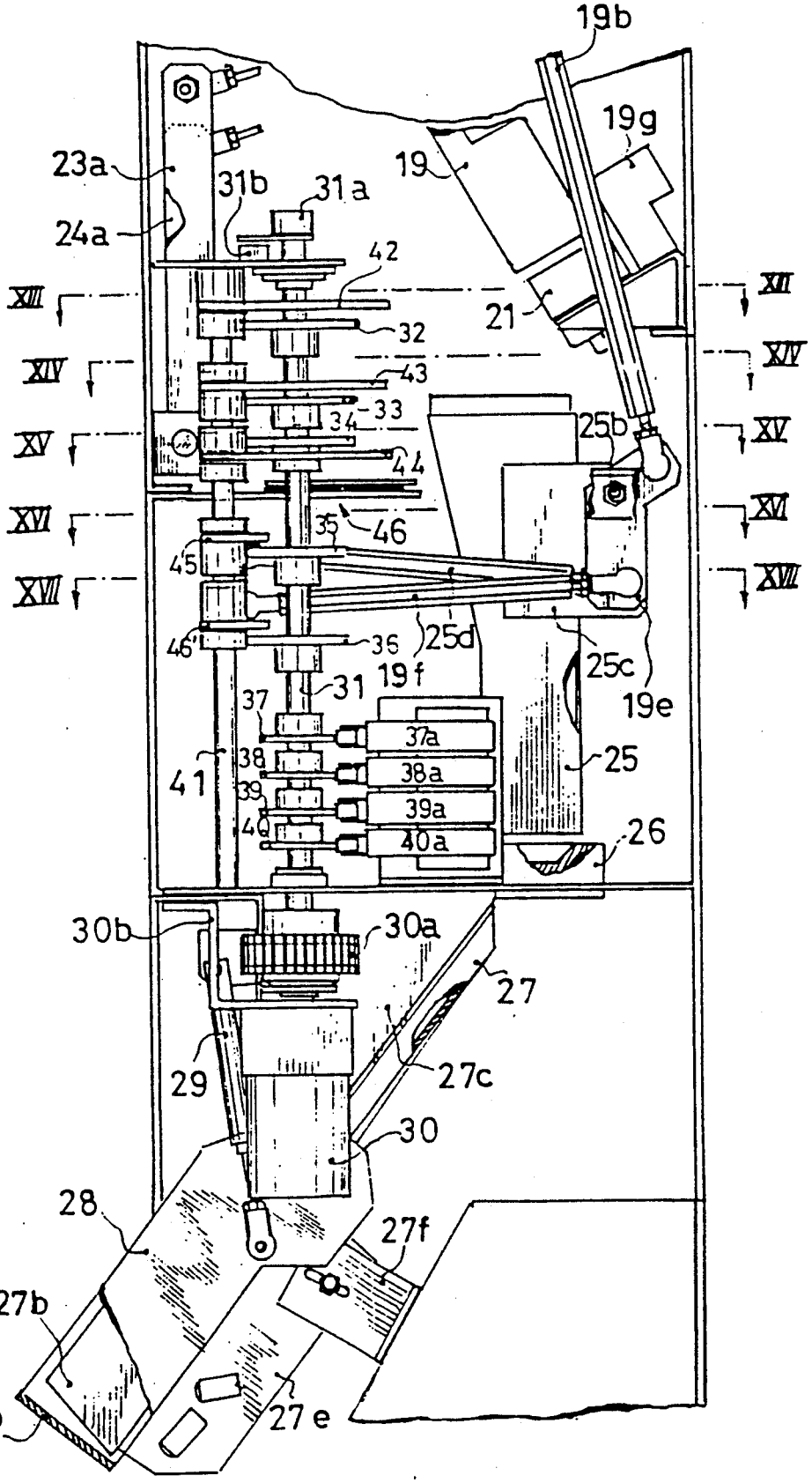

The cop holding cylinder 25 of the stand-by/storage device 9, as shown in FIGS. 11 and 12, is a square-shaped through cylinder whose upper portion is gradually larger toward the front side and is opened. The cop holding cylinder 25 is fixed to a pivotable frame 25c, and a slit 25a is formed vertically on the front side thereof. As shown in FIG. 12 (right side view of FIG. 11) and FIG. 16 (a sectional view taken on line XVI—XVI in FIG. 12 as seen in the direction of arrow), the pivotable frame 25c is pivotally supported by a shaft 25b mounted to both sides of the frame through a bracket, and one end of an actuating rod 25d is pivotally connected to part of the shaft 25b. The holding cylinder 25 maintains its stand-by position substantially vertically in the state illustrated in FIG. 12, and a support base 26 mounted to the frame side as in FIG. 11 is disposed under the holding cylinder 25. Also in the support base 26 is formed a recess 26a for supporting the cop base, like the support base 21.

The cop introduced into the holding cylinder 25 is allowed to stand by while a yarn end thereof is grasped by the suction/holding/guide device 22, and as the frame 25c is pivoted clockwise by the operation of the actuating rod 25d, the cop is introduced into the introducing/retaining device 10 disposed below the holding cylinder 25. In this case, since a yarn end of the cop is held by the suction/holding/guide device 22 and has been conducted to the position above the cutter 46, the cop is drawn out from the slit 25a of the holding cylinder while being unwound.

The yarn end cutter 46, which is disposed in front of the holding cylinder 25 as shown in FIGS. 11 and 12, is mounted to the frame and is provided on a guide plate 47 having a yarn guide slot 47a. The cutter 46 is composed of a fixed blade 46a mounted to cross the guide slot 47a obliquely and an operating blade 46b pivotally secured to part of the fixed blade. Further, one end of an actuating rod 44a is pivotally connected to part of the operating blade 46b. In the state shown in FIG. 15, the operating blade 46b has been turned clockwise to open the cutter. By the pivoting motion of the holding cylinder 25 a yarn end of the cop which is dropped to the retaining/introducing device 10 is conducted to between the opened cutting edges.

Figure 19:
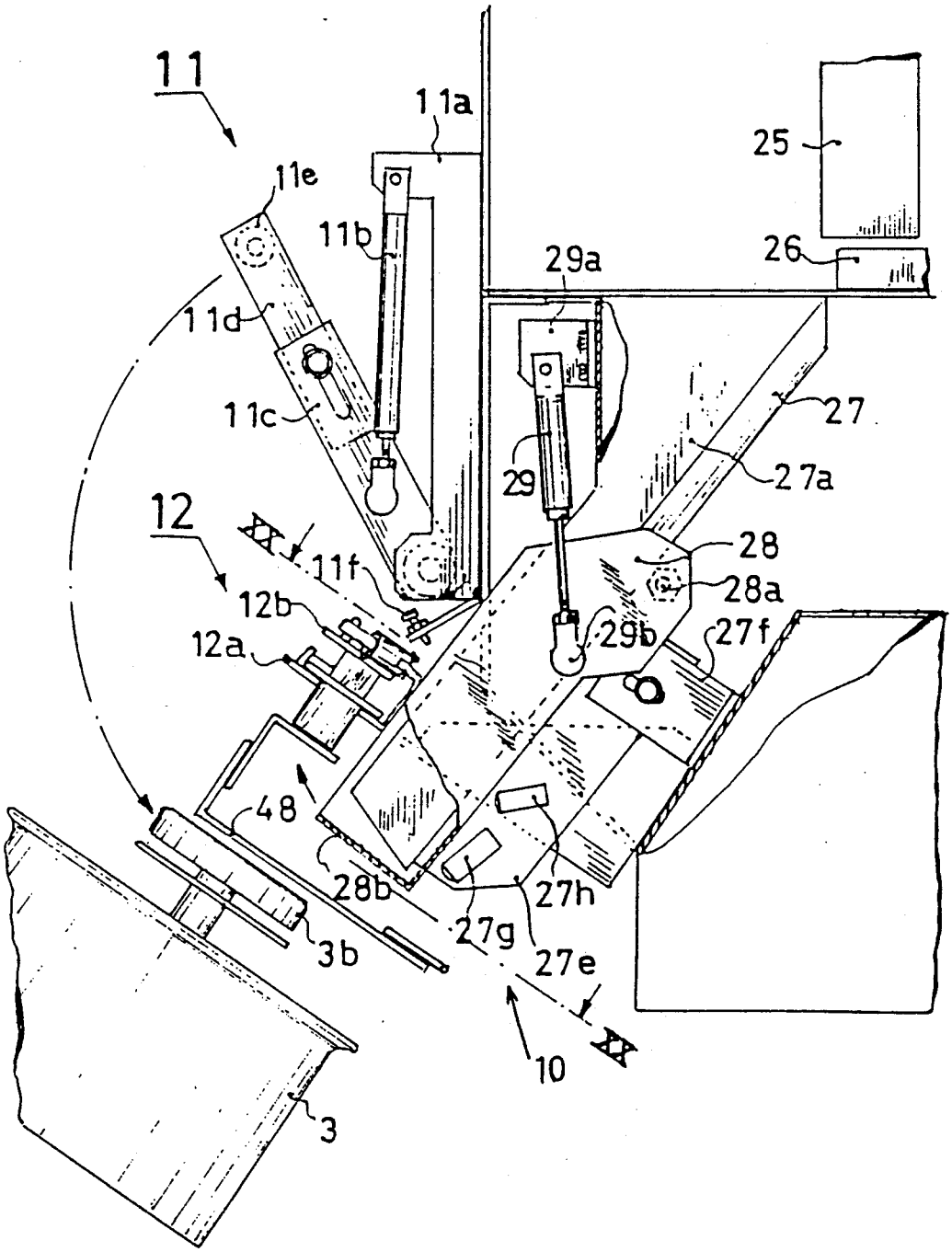

On the other hand, as shown in FIGS. 11, 12 and FIG. 19 (a partially enlarged view of FIG. 3), the retaining/introducing device 10 is composed of a chute 27 which is fixed in an inclined state and a pivotable rod 28 which is provided pivotably on the lower cop introducing side. The chute 27 has a concave bottom to slide the cop stably, while on the front side thereof is provided a guard 27c. Further, a support plate 27e is fixed to one side of the back of its bottom and it is mounted to the frame through a bracket 27f, whereby the chute 27 is supported. A cop discharge port 27b faces the cop introducing portion of the magazine which will be described later. The pivotable rod 28 is constituted by a ]-shaped frame which forms a cop retaining front wall 28b, and the upper portion thereof is pivotally supported in a lower position by a pivot shaft 28a fixed to the bottom back of the chute 27. Further, a piston 29b of an actuating cylinder 29 is pivotally supported by part of one-side wall of the pivotable rod 28. The actuating cylinder 29 is pivotally connected at one end thereof to a bracket 29a mounted to the front face of the guard 27c. In this construction, a cop which has been dropped into the chute 27 slides down and is retained by the front wall 28b when the pivotable rod 28 is in the illustrated position.

On the other hand, the support plate 27e is provided with detectors 27g and 27h, as shown in FIG. 19. The detector 27g is for detecting the presence of a cop in the cop introducing portion of the magazine 3, while the detector 27h is for detecting the presence of a cop retained in the chute 27. The cop feeding apparatus 1 is constructed to detect an empty spindle portion of a magazine in the position opposed to the magazine during travelling for the feed of cop, and stops. The detector 27g is for re-confirming this empty spindle portion. When the presence of a cop retained in the chute 27 is detected, a cop feeding operation which will be described later is started. The detector 27h detects the presence of a retained cop through a window hole 27d formed in the chute 27, as shown in FIG. 18 (a partial side view of the left-hand side of FIG. 19, with a portion not shown).

In feeding a cop to the magazine 3, it is necessary to draw out a yarn end of the cop and have it cut by the cutter 46, conduct a yarn end of the cop which has been introduced into the magazine to a yarn end suction/holding device 3b provided in the magazine, and open a yarn end suction portion 3e of the magazine in advance. To this end, in the front portion of the cop feeding apparatus 1 there are provided a suction port opening device 11 and a yarn end guide device 12 (FIG. 19), for the magazine.

Figure 18:
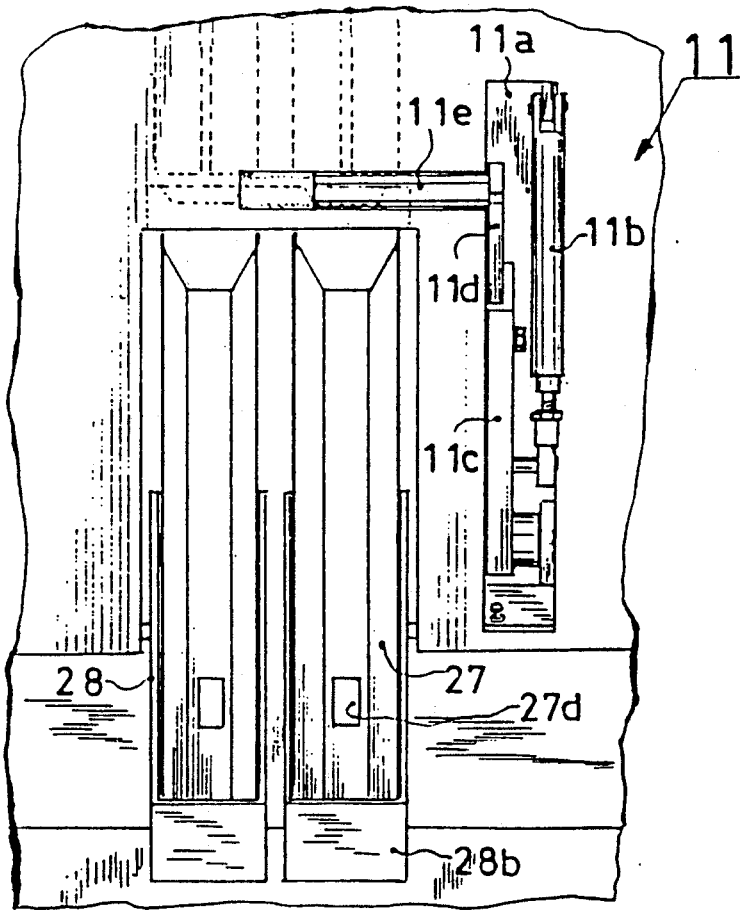

In the opening device 11, as shown in FIGS. 18 and 19, one end of a pressing arm 11e is mounted perpendicularly to the front tend of an arm rod 11d is mounted to a rotating arm rod 11c so as to be adjustable its length. The other end of the rotating arm rod 11c is pivotally connected to the lower end of a bracket 11a which is mounted to the frame. The piston of an actuating cylinder 11b is pivotally supported nearly centrally of the arm rod 11c. The other end of the cylinder 11b is pivotally secured to the upper portion of the bracket 11a. Therefore, upon operation of the actuating cylinder 11b, the pressing arm 11e moves in the direction indicated by an arrow in FIG. 19 to displace the yarn end guiding suction board 3b which is provided in the magazine 3 and urged in one direction, against the urging force. More specifically, as shown in FIG. 20 (a sectional view taken along line XX—XX in FIG. 19 as seen in the direction of arrow), a yarn end suction port 3d of the guide board 3b is made coincident with the suction port 3e which is open in the back side of the guide board 3b to form a suction air stream (upward displacement in FIG. 20).

The numeral 11f in FIG. 19 denotes an operation restricting stopper for the rotating arm rod 11c, which stopper functions to restrict the amount of displacement for coincidence between the suction port 3e and the yarn end suction port 3d. It is preferable that the arm rod 11d be formed by or coated with an elastic material.

In the retaining/introducing device 10, after the magazine suction board 3b is displaced to form a suction air stream in the suction port 3d, the actuating cylinder 29 is operated to pivot the pivotable rod 28 counterclockwise as indicated by an arrow (FIG. 19), thereby dropping the cop retained on the front wall 28*b* into the magazine 3. Simultaneously with or slightly later than this dropping of the cop, the cutter 46 operates to cut a yarn end of the cop. The cut edge side of the yarn end is held by the suction/holding device 22. Slightly later than the cutting operation, only the opening/closing plate 24 is displaced as in FIG. 10, whereby the cut end is sucked in by the suction pipe 23*b* of the suction board 23.

Figure 20:
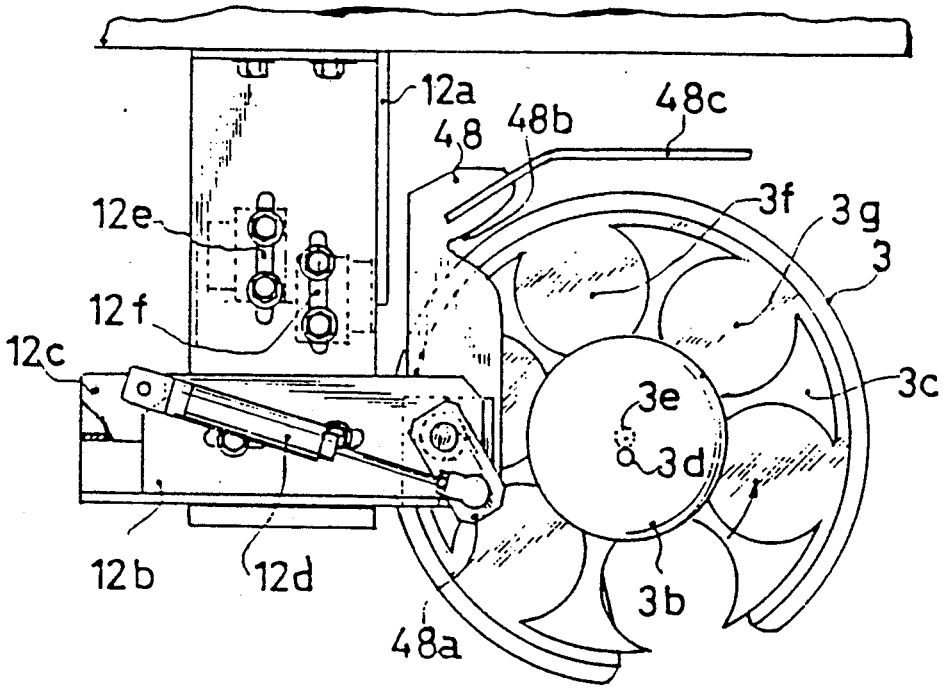

In the yarn end guide device 12, as shown in FIGS. 19 and 20, a support plate 12*b* is provided through a bracket 12*a* on the front side of the frame, and a shaft support portion is formed on one end side of the support plate 12*b*. A shaft is loosely supported through the said shaft support portion, and one end of an arm plate 48*a* is mounted to the upper end of the said shaft, while one end of a long arm rod 48 is mounted to the lower end of the same shaft. On the front end side of the arm rod 48 there is formed a yarn end introducing/guide slot 48*b*, and a long yarn end guide rod 48*c* is fixed thereto. Further, a piston-side end of an actuating cylinder 12*d* is pivotally secured to the other end of the arm plate 48*a*, and the other end of this actuating cylinder is pivotally supported by a base plate portion 12*c* formed on one end side of the support plate 12*b*. The illustrated position indicates a stand-by state wherein the arm rod 48 has been retracted. The interior of the magazine 3 is partitioned by a rotary tube creel 3*c* so that the feed of cop to empty spindle portions 3*g* or 3*f* and 3*g* may not be impeded by the arm rod 48, etc.

Before the cop is fed to each of such empty spindle portions, a yarn end thereof is cut into a predetermined length by the cutter 46, then the cop is fed and thereafter the actuating cylinder 12*d* is operated, whereby the arm rod 48 is turned 45° clockwise. As a result, yarn end(s) of one or two cops is conducted to the suction port 3*d* of the suction board 3*b* through the guide slot 48*b*, wherein the yarn end(s) is sucked in by a suction air stream. Then, the pressing arm 11*e* returns to its original position and consequently the suction board 3*b* also assumes its original position, whereby the yarn end of the cop introduced is held and now the feed of the cop is completed.

The following description is now provided about the operation of the cop feeding apparatus 1 and also about an actuating means for the devices provided in the apparatus 1. In the cop feeding apparatus 1, when a sensor 1*d* provided in part of the back side of the upper portion of the apparatus 1 and a positioning detector 2*d* attached to the guide rail 2 (see FIG. 3 for the 1*d* and 2*d*) become coincident with each other, a later-described sensor starts operation. In the magazine are detected by photoelectric sensors 12*e* and 12*f* which are indicated by broken lines in FIG. 20. The sensors 12*e* and 12*f* are provided on the back side of the bracket 12*a*. The sensor 12*e* detects an empty spindle portion 3*f* in the magazine, while the sensor 12*f* detects an empty spindle portion 3*g*. When one of these sensors detects an empty spindle portion, the cop feeding apparatus 1 decreases its travelling speed, and when a positioning sensor provided on the feeding apparatus side become coincident with the detector 2*d* attached to the guide rail, the apparatus 1 causes the chute 27 of the retaining/holding device to be opposed to the empty spindle portion of the magazine and stops. The detectors 27*g* and 27*h* also re-confirm these empty spindle portions to start the cop feeding operation.

On the other hand, the actuating mechanism in the cop feeding apparatus 1 comprises driving shafts 31 provided vertically and support shafts 41 disposed in parallel with the driving shafts 31. These shafts are loosely supported on base plates of the frame. Each driving shaft 31 is connected at the lower portion thereof to a driving motor 30 through a coupling 30*a*. A large number of cams 32, 33, 34, 35, 36 and 37–40 are mounted successively from above onto the driving shaft 31, while onto each support shaft 41 are loosely supported, after positioning, levers 42, 43, 44, 45 and 46' in an opposed relation to the cams 32, 33, 34, 35 and 36, respectively. These levers are each provided with a cam ball, which is brought into abutment with the associated cam through a tension spring. The cams 37–40 mounted on the driving shaft 31 are opposed to changeover valve operating switches 37*a*–40*a*, respectively, which are provided as a group. As the driving shaft 31 rotates exactly once, there are performed the introduction of a retained cop, dropping of a stored cop, operation of the yarn end cutter and the cutting of a yarn end. A rotation detecting arm rod 31*a* is attached to the top of the driving shaft 31 to restrict a single rotation of the motor 30 in association with a proximity switch 31*b* provided on the support base side.

Figure 13:
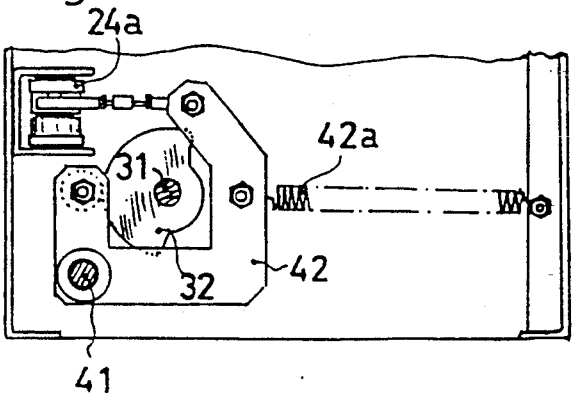
Figure 14:
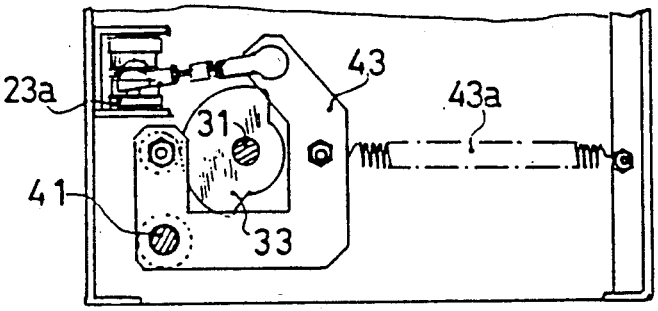

As shown in FIG. 13 (a sectional view taken on line XIII—XIII in FIG. 12 as seen in the direction of arrow), the cam 32 and the lever 42 are connected through a connecting rod to the actuating rod 24*a* of the opening/closing plate 24 in the yarn end suction/holding/guide device 22, and the opening/closing plate 24 is caused to slide by the rotation of the cam 32. On the other hand, as shown in FIG. 14 (a sectional view taken on line XIV—XIV in FIG. 12 as seen in the direction of arrow), the cam 33 and the lever 43 are connected through a connecting rod to the actuating rod 23*a* of the suction board 23 in the yarn end suction/holding/guide device 22. The lower ends of the actuating rods 24*a* and 23*a* are each supported through a shaft to the bracket 22*c* attached to the frame (see FIG. 12), while on their top side they are connected to the opening/closing plate 24 and the suction board 23, respectively, through connecting rods.

Therefore, as the cams 32 and 33 rotate once, the suction/holding/guide device 22 moves between the upper portion of the receiving cylinder 19 and that of the cutter 46, as shown right and left in FIG. 8. Only the opening/closing plate 24 is displaced earlier than the suction board 23 and sucks in a yarn end and both hold the yarn end in an overlapped state and conduct it upward of the cutter.

Figure 15:
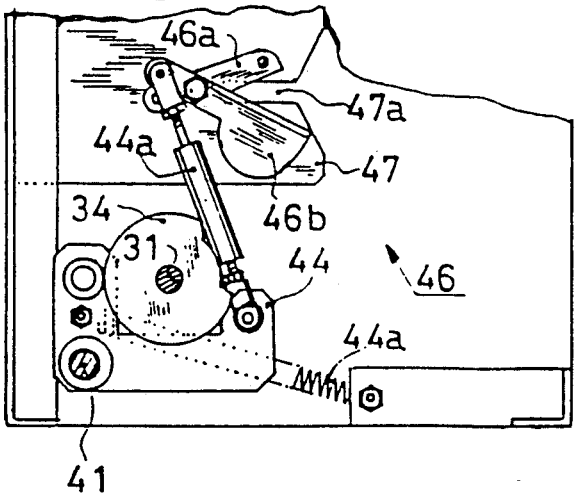
Figure 16:
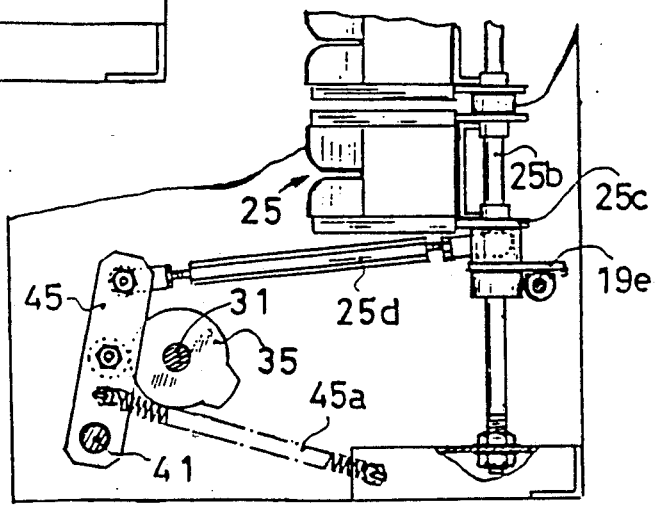
Figure 17:
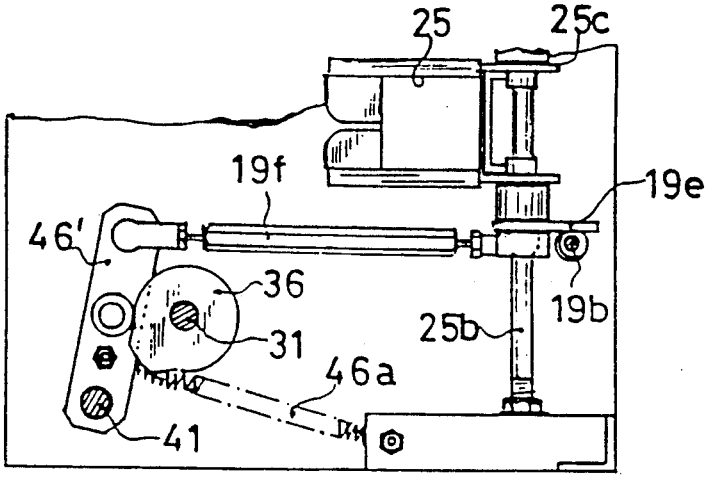

Then, as shown in FIG. 15, the cam 34 and the lever 44 actuate the yarn end cutter. The other end side of the actuating rod 44*a* is pivotally supported at the front end of the lever 44. Therefore, as the cam 34 rotates once, the operating blade 46*b* turns and cuts the yarn end located in the guide slot 47*a*. As shown in FIG. 16, the cam 35 and the lever 45 pivot the holding cylinder 25 of the stand-by/storage device 9. The other end of the actuating rod 25*d* is pivotally supported at the front end of the lever 45. During a single rotation of the cam 35, the holding cylinder 25 is pivotally moved clockwise, allowing the stored cop to drop into the chute 27. In the cam 36 and the lever 46', as shown in FIG. 17 (a sectional view taken along line XVII—XVII in FIG. 12 as seen in the direction of arrow), a connecting rod 19*f* is pivotally connected at one end thereof to the front end of the lever 46' and at the other end thereof to one end of a swing lever 19*e* which is loosely supported by the support shaft 25*b* of the pivotable rod 25*c* with the holding cylinder 25 mounted thereto. On the opposite end side of the swing lever there is pivotally supported the other end side of the actuating rod 19*b* for pivoting the mounting frame 19*a* of the receiving cylinder 19 in the yarn end draw-out device 8. In this construction, as the cam 36 rotates once, the receiving cylinder 19 moves pivotally, whereby the cop whose yarn end has been drawn out is dropped into the holding cylinder 25.

On the other hand, the operating switches 37*a* to 40*a* which are provided in a corresponding relation to the cams 37 to 40, respectively, mounted on the driving shaft 31 function to operate change-over valves for pressurized air and pipes (not shown) connected to actuating cylinders. The switch 37*a* operates to feed air for blowing up a yarn end of the cop stored in the receiving cylinder 19 and feeds air to the vent hole 21*b* formed in the support base 21. The switch 38*a* is for introducing a suction air stream in the suction pipe 23*b* attached to the suction board 23 and sucking in a yarn end of the stored cop under displacement of the opening/closing plate 24. The switch 39*a* is for operating the actuating cylinder 12*d* of the yarn end guide device 12 to pivot the turn the pivotable arm 48 and conduct the yarn end to the yarn end guide board 3*b*. The switch 40*a* is for operating the actuating cylinder 29 in the retaining/introducing device 10 to feed the retained cop to the magazine and also for operating the actuating cylinder 11*b* of the opening device 10 to open the suction board 3*b* of the magazine and thereby form a yarn end suction air stream.

These operations are performed in the following order. First, as the driving shaft 31 rotates once, the yarn end suction/holding device 22 of the yarn end draw-out device 8 assumes its stand-by position above the cutter 46, and the suction air stream in the suction pipe of the suction board 23 is introduced, while the opening/closing plate 24 is displaced to form a suction air stream. Then, the cop retained in the retaining/introducing device is fed and the yarn end guide board 3*b* on the magazine side is displaced to form a suction air stream. Subsequently, the yarn end guide device 12 operates to conduct a yarn end to the guide board 3*b*, then the cutter 46 operates to suck in the yarn end which has been conducted to the guide board. Then, the yarn end suction/holding device 22 moves the opening/closing plate 24 as displaced (under suction) to above the receiving cylinder 19 and at the same time pressurized air is introduced into the vent hole 21*b* of the support base 21. Then, the pivotable rod 28 of the retaining/introducing device 10 which has been pivoted and remains open is returned to its cop retaining position (as shown) and the pivotable arm 48 of the yarn end guide device 12 is also returned to its stand-by position (as shown). Subsequently, the cutter 46 which remains closed after its operation is returned to its open state (as shown) and then the stand-by/storage device 9 is operated to drop the stored cop into the chute 27 and allow it to be retained by the retaining/introducing device 10. Then, the yarn end suction/holding device 22 is returned to its stand-by position and the opening/closing plate 24 and the suction board 23 are lapped together to close the suction air stream. At the same time, the pressurized air introduced on the support base 21 side is cut off. Then, the receiving cylinder 19 of the yarn end draw-out device 8 is pivoted, allowing the stored cop to be introduced into the holding cylinder 25 of the stand-by/storage device 9. Subsequently, the suction air stream in the suction pipe 23*b* is cut off. Now, a series of operations are over.

Thus, the cop feeding apparatus of the present invention take in and store fed cops each individually and separately by utilizing tray conveyance; besides, the storage of cops is performed in plural stages. Then, a yarn end of each cop is drawn out and the cops are fed to the magazine while being shifted successively to the lower-state side. In this construction, the contact of cops is reduced and the cops are not stained. Moreover, since cops do not contact each other, there is no entanglement of yarn and the cops can be fed smoothly to the magazine. Further, since the devices used in the cop feeding apparatus are operated by rotating a single shaft once, operations are associated with one another in good order, there occur few troubles, and the maintenance and control are easy.

I claim:

1. A cop feeding apparatus for an automatic winder provided with cop magazines of the type having a yarn end suction port, said cop feeding apparatus being adapted to move along a cop tray conveying rail and functioning to pull out cops from trays and feed them to empty spindle portions of the cop magazines automatically, said cop feeding apparatus comprising:

cop pull-out means for pulling out a cop from a tray on said conveying rail;

cutter means for cutting a yarn end of the pulled-out cop;

yarn end draw-out means for temporarily storing the pulled-out cop, drawing out said yarn end of the cop and conducting the yarn end to said cutter means while holding the yarn end;

storage means for temporarily storing the cop dropped from said yarn end draw-out means;

retaining/introducing means for allowing the cop dropped from said storage means to slide and then retaining the cop temporarily on a lower outlet side thereof, said retaining/introducing means having a pivotable frame for rocking the retained cop to drop it onto an empty spindle portion of a cop magazine;

means for opening the yarn end suction port of each cop magazine; and yarn end guide means for conducting a yarn end of the cop dropped onto an empty spindle portion of the cop magazine to said yarn end suction port.

2. A cop feeding apparatus for an automatic winder according to claim 1, wherein said cop pull-out means is provided with a movable base adapted to move forward and backward with respect to said tray conveying rail, an arm rod pivotably secured to said movable base, a chute for delivering a pulled-out cop to said storage means, and a pivotable guard for introducing the pulled-out cop into said chute.

3. A cop feeding apparatus for an automatic winder according to claim 2, wherein said yarn end draw-out means comprises left and right yarn end draw-out devices, and wherein said cop pull-out means is adapted to traverse between said left and right yarn end draw-out devices.

4. A cop feeding apparatus for an automatic winder according to claim 1, wherein said yarn end draw-out means is provided with a pivotable receiving cylinder, a cop supporting base disposed in a position under said receiving cylinder, and yarn end suction/holding/guide means disposed in a position above said receiving cylinder to suck in and hold a yarn end of the cop.

5. A cop feeding apparatus for an automatic winder according to claim 4, further comprising:

a suction pipe for providing suction to said suction/-holding guide means;

an upper rotating plate having a suction port in communication with said suction pipe; and a lower rotating plate in contact with the underside of said upper rotating plate, said lower plate being mounted so as to be rotatable separately from the operation of the upper rotating plate and having a recess in an opposed relation to said suction port of the upper rotating plate.

6. A cop feeding apparatus for an automatic winder according to claim 1, wherein said storage means has a pivotable cop holding cylinder, and wherein said cutter means is disposed in front of said storage means.

7. A cop feeding apparatus for an automatic winder according to claim 1, wherein said yarn end suction port opening means includes a pivotally mounted pressing arm contactable with the magazine and a pivotable arm plate for conducting a cut yarn end to the yarn end suction port of the magazine.

8. A cop feeding apparatus for an automatic winder according to claim 1, further comprising a common driving shaft, wherein said yarn end draw-out means, said storage means, said retaining/introducing means, said opening means and said yarn end guide means is controlled by said common driving shaft.

9. A cop feeding apparatus for an automatic winder according to claim 1, wherein said cop feeding apparatus includes:

a left row having a left yarn end draw-out device, a left storage device, and a left retaining/introducing device; and a right row having a right yarn end draw-out device, a right storage device, and a right retaining/introducing device.

* * * * *